US009428307B2

(12) United States Patent
Zerfas et al.

(10) Patent No.: US 9,428,307 B2
(45) Date of Patent: Aug. 30, 2016

(54) ADHESIVE RECLOSABLE FASTENERS WITH VISUAL INDICATORS

(71) Applicant: INTERCONTINENTAL GREAT BRANDS LLC, East Hanover, NJ (US)

(72) Inventors: Paul A. Zerfas, East Hanover, NJ (US); Arthur A. Sagy, East Hanover, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 0 days.

(21) Appl. No.: 14/775,625

(22) PCT Filed: Mar. 6, 2014

(86) PCT No.: PCT/US2014/021084

§ 371 (c)(1),
(2) Date: Sep. 11, 2015

(87) PCT Pub. No.: WO2014/149825

PCT Pub. Date: Sep. 25, 2014

(65) Prior Publication Data

US 2016/0023810 A1 Jan. 28, 2016

Related U.S. Application Data

(60) Provisional application No. 61/793,341, filed on Mar. 15, 2013.

(51) Int. Cl.

| | |
|---|---|
| ***B65D 33/00*** | (2006.01) |
| ***B65D 33/34*** | (2006.01) |
| ***B65D 75/58*** | (2006.01) |
| ***B65D 33/20*** | (2006.01) |
| ***B65B 9/20*** | (2012.01) |

(Continued)

(52) U.S. Cl.
CPC ..... *B65D 33/34* (2013.01); *B65B 9/20* (2013.01); *B65B 51/02* (2013.01); *B65B 61/18* (2013.01); *B65B 61/188* (2013.01); *B65D 33/20* (2013.01); *B65D 75/5855* (2013.01)

(58) Field of Classification Search
CPC ..... B65D 33/20; B65D 75/5855
USPC ..... 383/5, 210, 211, 93, 95
See application file for complete search history.

(56) References Cited

U.S. PATENT DOCUMENTS 4,557,505 A * 12/1985 Schaefer ..... B44F 1/00 206/807
4,709,397 A * 11/1987 Voshall ..... B65D 27/30 206/459.1

(Continued)

*Primary Examiner* — Jes F Pascua
(74) *Attorney, Agent, or Firm* — Fitch, Even, Tabin & Flannery LLP

(57) ABSTRACT

A flexible package and method for manufacturing thereof is provided. The flexible package includes a first layer of adhesive material disposed on an interior surface of the rear panel of the package. The adhesive material of the first layer includes at least one visual indicator formed by at least one area of predetermined shape that is more translucent than adjacent areas of the adhesive material of the first layer. A second layer of adhesive material is disposed on an interior surface of the front panel. The second layer of adhesive material is located opposite the first layer of adhesive material. When the flexible package is not completely sealed, the visual indicator in the adhesive material of the first layer is not visible through the adhesive material of the second layer. When the flexible package is sealed, the visual indicator is visible through the second layer of adhesive material.

20 Claims, 5 Drawing Sheets

(51) Int. Cl.
*B65B 61/18* (2006.01)
*B65B 51/02* (2006.01)

(56) References Cited

U.S. PATENT DOCUMENTS 5,064,664 A * 11/1991 Hustad ..... B65D 75/5855 206/459.1
5,103,979 A * 4/1992 Hustad ..... B65D 33/34 206/459.1
5,427,266 A * 6/1995 Yun ..... B65D 25/54 116/200
5,791,783 A * 8/1998 Porchia ..... B65D 33/20 383/211
5,832,145 A * 11/1998 Dais ..... B65D 33/20 383/211
5,882,749 A * 3/1999 Jones ..... B32B 27/322 428/34.8
7,579,061 B2 * 8/2009 Dronzek, Jr. ..... B32B 27/08 206/807
7,611,284 B2 * 11/2009 Borchardt ..... B65D 33/2541 24/585.12
7,658,543 B2 * 2/2010 Shiokawa ..... B32B 27/08 383/107
9,096,780 B2 * 8/2015 Zerfas ..... B32B 3/085

* cited by examiner

ADHESIVE RECLOSABLE FASTENERS WITH VISUAL INDICATORS

CROSS REFERENCE TO RELATED APPLICATIONS

This application is a U.S. national phase application of International Application No. PCT/US2014/021084, filed Mar. 6, 2014, which claims benefit from U.S. Application 61/793,341, filed Mar. 15, 2013, which are hereby incorporated herein by reference in their entirety.

FIELD

This disclosure relates generally to reclosable fasteners for flexible packages and, in particular, to adhesive-based reclosable fasteners with open/close visual indicators for flexible packages.

BACKGROUND

Several types of closures or fasteners are available for reclosing a previously opened flexible package. For example, it is common to use mechanical reclosable fasteners, such as slider zippers, clips, tabs, interlocking strips, and the like. Such mechanical closures can have colored and/or uncolored interlocking components that can both reclose a package and indicate to a user that the package has been reclosed. Such mechanical closures can be expensive, bulky, complex structures that require separate molding and fabrication steps prior to being joined to the flexible film used to form the package. In addition, while mechanical closures can be applied in form-fill-seal operations, the mechanical closures often require complex and expensive manufacturing steps to apply, interconnect, and align the mechanical fastening features of each structure. Therefore, mechanical reclosable fasteners often add undue complexity and cost to the manufacturing process of the flexible packages.

Adhesive-based reclosable fasteners provide one alternative to the mechanical fasteners. For example, thermoplastic elastomers, which are sometimes called thermoplastic rubber, have been used to form reclosable pressure sensitive adhesive type fasteners. Some types of thermoplastic elastomer copolymers (especially certain styrenic block polymers) demonstrate high cohesive properties, and at the same time have low tack levels or a reduced tendency to adhere to unlike materials (i.e., food materials such as cookies, crackers, shredded cheese and the like). Such adhesive-based reclosable fasteners typically include adhesive material, typically in the form of strips, formed opposite one another on interior surfaces of the side walls of the packages. One draw-back of the known adhesive-based reclosable fasteners is that they do not typically provide an indicator to tell the consumer whether the package has been properly or improperly closed or reclosed. While some adhesive-based reclosable fasteners include color-changing indicators, such color-changing indicators may be ineffective for some users because the color change is not readily apparent, and for other users because they happen to be color-blind. Further, production of such color-changing adhesive-based reclosable fasteners adds complexity and cost to the flexible packaging manufacture.

SUMMARY

In one approach, a flexible package comprises a top end, a bottom end, a first side edge, a second side edge opposite the first side edge, a front panel, and a rear panel joined together to form an interior therebetween configured to retain a product. The package further includes a first layer of adhesive material disposed on an interior surface of the rear panel. The adhesive material of the first layer includes at least one visual indicator formed by at least one area of predetermined shape that is more translucent than adjacent areas of the adhesive material of the first layer. The package also includes a second layer of adhesive material disposed on an interior surface of the front panel. The second layer of adhesive material is positioned opposite the first layer of adhesive material to permit the flexible package to be sealed when the first layer of adhesive material and the second layer of adhesive material are brought into contact with each other. When the flexible package is not sealed, the at least one visual indicator in the adhesive material of the first layer is not visible through the adhesive material of the second layer, and when the flexible package is sealed, the at least one visual indicator is visible through the second layer of adhesive material.

The first layer and second layers of adhesive material may be in a form of at least one strip extending from the first side edge to the second side edge of the flexible package.

The shape of the at least one visual indicator can be one of a geometric shape selected from one of circular, rectangular, triangular, and polygonal, and a calligraphic shape selected from one of single words and phrases.

The adhesive material of the first and second layers of adhesive material may be partially opaque or translucent and may include a colorant in an amount of approximately from about 0.1 percent to about 4 percent by weight. The colorant may be selected from one of titanium dioxide, calcium carbonate, talc, or any of a variety of organic of inorganic colorants, either alone, or in combinations.

The first and second layers of adhesive material may each have a thickness of approximately from about 0.0001 to about 0.005 inches.

The first layer of adhesive material may be partially opaque except for the at least one area that is more translucent than adjacent areas of the adhesive material and forms the at least one visual indicator, and the second layer of adhesive material is partially opaque or uniformly translucent.

In one approach, a method of manufacturing the flexible package described herein comprises applying the first layer of adhesive material including the at least one area of predetermined shape to a portion of the interior surface of the rear panel of the flexible package, and applying the second layer of adhesive material to a portion of the interior surface of the front panel of the flexible package opposite the portion of the interior surface of the rear panel of the flexible package.

The method may include bringing the front panel and the rear panel of the flexible package toward each other until the first layer of adhesive material comes into contact with the second layer of adhesive material and the flexible package is sealed.

The method may also include applying the second layer of adhesive material to the portion of the interior surface of the front panel of the flexible package continuously from the first side edge of the flexible package to the second side edge of the flexible package.

The method can also include applying the first layer to the portion of the interior surface of the rear panel of the flexible package continuously from the first side edge of the flexible package to the second side edge of the flexible package.

In one form, the first and second layers of adhesive material each include a colorant in an amount of approximately from about 0.1 percent to about 4 percent by weight.

In one approach, a method of reclosing the flexible package described herein comprises bringing the front panel and the rear panel of the flexible package toward each other until the first layer of adhesive material comes into contact with the second layer of adhesive material and the at least one visual indicator in the first layer of adhesive material is visible through the second layer of adhesive material.

In one approach, a flexible package including a reclosable fastener comprises a top end, a bottom end, a first side edge, a second side edge opposite the first side edge, a front panel, a rear panel joined together to form an interior therebetween configured to retain a product, and a reclosable fastener. The reclosable fastener includes a first strip of adhesive material disposed on an interior surface of the rear panel such that the adhesive material of the first strip has a first translucence level and including at least one area forming a visual indicator and being more translucent than adjacent portions of the first strip of the adhesive material. The reclosable fastener also includes a second strip of adhesive material disposed on an interior surface of the front panel such that the adhesive material of the second strip has a second translucence level. The second strip of adhesive material is positioned opposite the first strip of adhesive material to permit the flexible package to be sealed when the first strip of adhesive material and the second strip of adhesive material are brought into contact with each other. When the flexible package is sealed, the reclosable fastener has a third translucence level in portions where the first strip of adhesive material is in contact with the second strip of adhesive material and a fourth translucence level where the at least one visual indicator is in contact with the second strip of adhesive material, the fourth translucence level being about 25-75% more translucent than the third translucence level such that the at least one visual indicator is visible through the second strip of adhesive material.

The first and second strips of adhesive material may each extend from the first side edge to the second side edge of the flexible package.

The at least one visual indicator can have a shape that is one of a geometric shape selected from one of circular, rectangular, triangular, and polygonal, and a calligraphic shape selected from one of single words and phrases.

The adhesive material of the first and second strips may include a colorant in an amount of approximately from 0.1 percent to 4 percent by weight.

In one form, the first translucence level can be equal to the second translucence level. When the flexible package is not sealed, the at least one visual indicator in the adhesive material of the first layer may not be visible through the adhesive material of the second layer. In an approach, neither the first strip of adhesive material nor the second strip of adhesive material changes color when the first and second strips of adhesive material are brought into contact with each other to seal the package.

DETAILED DESCRIPTION OF THE DRAWINGS

Generally, an adhesive fastener system of reclosable fastener including visual indicators having a variable opacity for flexible packages is provided. The adhesive fastener is an adhesive or cohesive material located on one or both of interior surfaces of the package that is sufficiently sticky to close the package and capable of multiple openings and reclosings. The system can include one or more strips or layers of adhesive coatings or applications on each of the front and rear panels forming walls of the package. In one approach, the adhesive on one of the walls can include one or more zones of predetermined patterns and shapes that are more translucent than the adjacent portions of the adhesive coatings. The shapes can be simple geometric figures, for example, circles, squares, triangles, or the like, or letters that form words and phases such as "CLOSED," "SAFETY SEAL," "FRESHNESS SEAL," or the like. Due to the contrasting translucence of coated and uncoated zones of the adhesive strips, the uncoated zones provide for a variable translucence or change in degree of translucence leading to a visual appearance change of the package when the two opposing adhesive strips are joined together to close or reclose the package, indicating to a user whether the package is properly sealed.

For purposes of this application, the terms "translucence" and "translucent" will be understood as the property of a material allowing at least some incident light to pass through while the transmitted light can be scattered; the term "light scattering" will be understood as a deflection of a ray of light from a straight path, for example by irregularities in the propagation medium, particles, or in the interface between two media; the terms "opaque" and "opacity" will be understood as the property of not allowing transmission of light; the terms "transparent" and "transparency" will be understood as the property of a material allowing light to pass through without being scattered; and the term "partially opaque" will be understood as the property of a material whereby some incident light is not transmitted, i.e., either absorbed or reflected.

Figure 1:
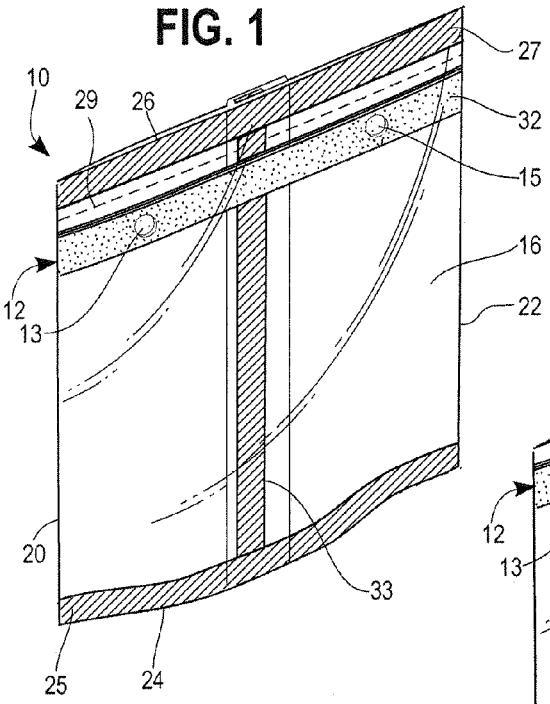
FIG. 1 is a front perspective view of an exemplary package with an intact top end seal and having a cohesive-based reclosable fastener illustrated in a properly sealed condition.
Figure 2:
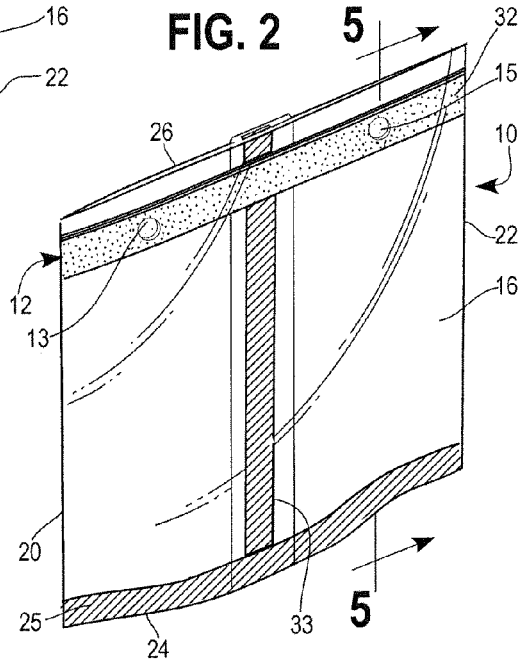
FIG. 2 is a front perspective view of the package of FIG. 1 illustrated in the properly sealed condition but with the top end seal having been removed.
Figure 3:
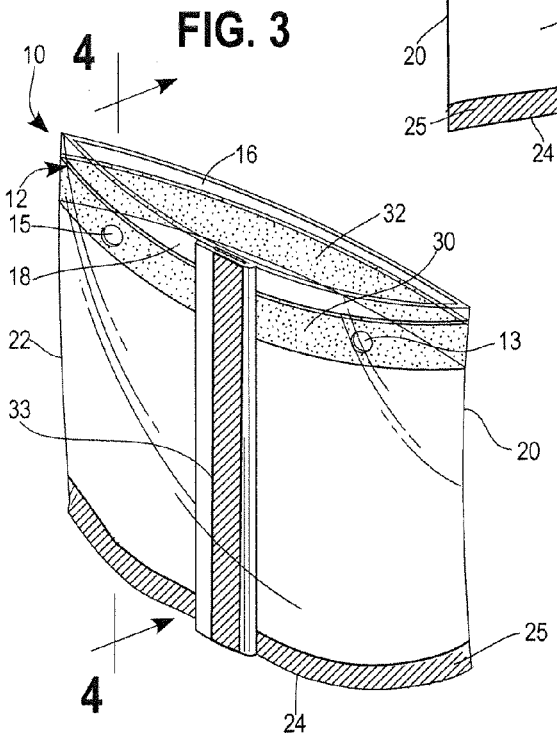
FIG. 3 is a rear perspective view of the package of FIG. 1 illustrated with the top end seal having been removed and in an open condition.
Figure 4:
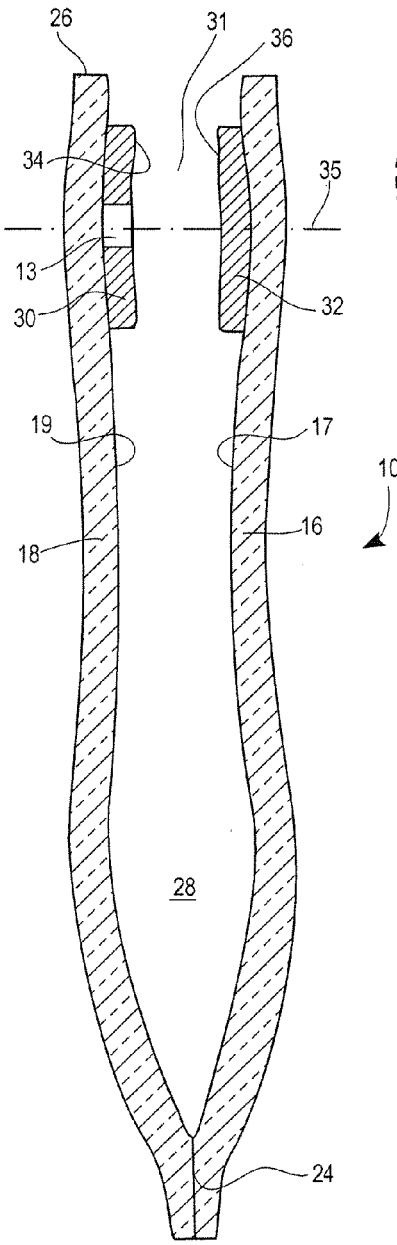
FIG. 4 is a side elevational view in cross-section of the package of FIG. 1 illustrated in the open condition.
Figure 5:
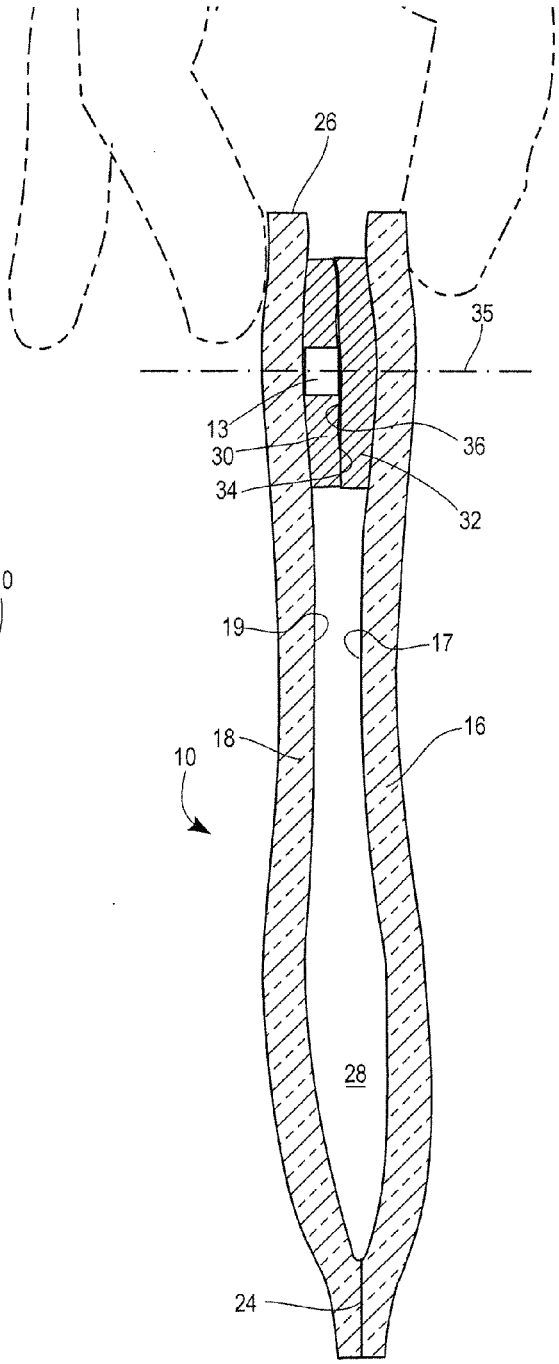
FIG. 5 is a side elevational view in cross-section of the package of FIG. 1 illustrated in the properly sealed condition.
Figure 6:
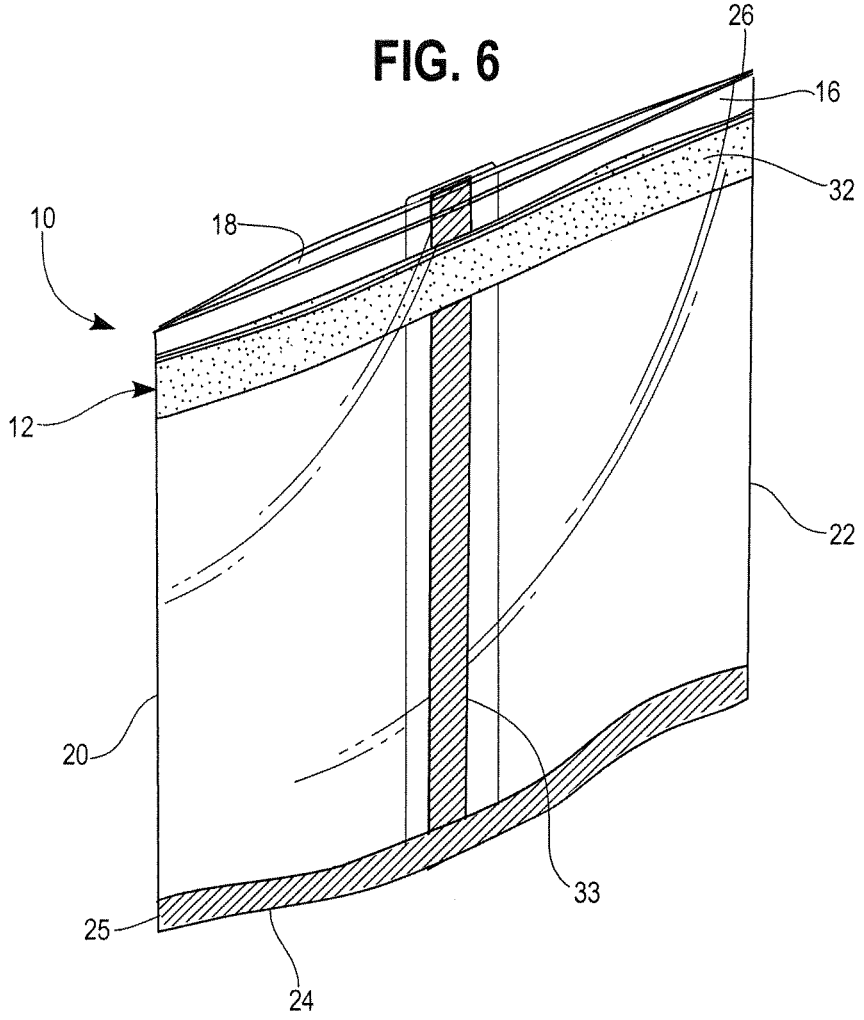
FIG. 6 is a front perspective view of the package of FIG. 2 illustrated in an improperly sealed condition.

In one approach, a flexible package 10 having an adhesive-based reclosable fastener 12 with visual indicators 13, 15 is disclosed herein and generally illustrated in FIGS. 1 to 6. FIGS. 1, 2, and 5 illustrate the package 10 being in a fully sealed or closed condition and FIGS. 3, 4, and 6 illustrate the package 10 that is not in a fully sealed or closed condition. In one exemplary form, the package 10 is formed from a flexible sheet material or film and includes a front flexible panel or wall 16 and rear flexible panel or wall 18. The package also includes a first side edge 20 and a second side edge 22 opposite the first side edge 20. The first and second side edges 20 and 22 of the package 10 each may include an end seal or a dead fold. The package further includes a bottom end 24 and a top end 26 opposite the bottom end 24. The front and rear walls 16 and 18, opposite side edges 20 and 22, and bottom and top ends 24 and 26 are joined together to form the flexible package 10 having an interior 28 (shown, for example in FIG. 5) for containing a food item or other products. The food item may be, for example, candy, cookies, nuts, crackers, or the like. The exemplary package is shown as being rectangular, but may have other shapes, sizes, and orientation as needed for particular applications.

With reference to FIG. 1, the bottom end 24 of the package 10 includes a bottom end seal 25 and the top end 26 of the package 10 includes a top seal 27. In one approach, the top end seal 27 may be separated from the package 10 along a line of weakness 29. The line of weakness 29 can be a score line, which, in one approach, can be scribed with one or more lasers in the flexible film material from which the package 10 is made. For example, a carbon dioxide laser or another suitable laser may be used to scribe the score line 29 in the front and rear side walls 16 and 18 of the package 10. In one approach, the package 10 may include a tear notch (not shown) aligned with the line of weakness 29.

The top end seal 27 provides a tamper-evident feature for the package 10 such that the absence of, or the partial removal of the top end seal 27 would indicate to a consumer that the package 10 has been previously opened or tampered with. Removal of the top end seal 27 provides an access opening 31 for accessing the hollow interior 28 as well as dispensing the contents of the package 10. The package 10 may further include other folds, seals, gussets, and/or flaps as generally needed for a particular application. For instance, as shown in FIG. 1, the package 10 may also include one or more fin seals 33 extending longitudinally from the top end 26 to the bottom end 24 of the package 10.

Referring to FIGS. 3 and 4, the reclosable fastener 12 includes a first layer or strip of adhesive material 30 on an interior surface 19 of the rear wall 18 of the package 10 and a second layer or strip of adhesive material 32 on an interior surface 17 of the front wall 16 of the package 10. As described in more detail below, the first and second layers of adhesive material 30 and 32 are positioned opposite each other to permit the flexible package 10 to be fully sealed when the first layer of adhesive material 30 is brought into contact with the second layer of adhesive material 32.

In the exemplary form shown in FIGS. 1-3, the first and second layers of adhesive material 30 and 32 are in the form of strips that run from the first side edge 20 to the second side edge 22 of the package 10, and are generally aligned with each other such that facing inner surfaces 34 and 36 of each fastener layer 30 and 32 oppose each other and are positioned to engage each other to form a closed or fully sealed condition of the package 10, shown, for example, in FIG. 5. As shown in FIG. 5, the inner-facing surfaces 34 and 36 of the first and second layers of adhesive material 30 and 32 are substantially parallel to each other when the package is in the sealed condition. While the reclosable fastener 12 has been shown by way of example only as being formed from first and second layers of adhesive material 30 and 32 in the form of generally parallel strips that continuously extend from the first side edge 20 to the second side edge 22 of the package 10, it will be appreciated that the reclosable fastener 12 may be formed in any suitable shape. In addition, the adhesive layers 30 and 32 do not have to be continuous from the first side 20 to the second side 22 and can extend across only a portion of the distance from the first side edge 20 to the second side edge 22 of the package 10.

In one approach, the first and second layers of adhesive material 30 and 32 of the fastener 12 are in the form of, for instance, a thin radiation-curable adhesive coating or layer which is normally transparent. In some cases, to make the fastener 12 more visible to a consumer, the first and second layers of adhesive material 30 and 32 may include a low concentration (in one approach, about 0.1 to about 4% by weight, in another approach, about 1 to about 4% by weight, in yet another approach, about 2 to about 3% by weight) of a pigment or colorant in order to provide some opacity to the adhesive. In one approach, titanium dioxide, calcium carbonate, or talc may be the pigment included in the first and second layers of adhesive material 30 and 32. The presence of pigment in the first and second layers of adhesive material 30 and 32 makes the layers 30 and 32 partially opaque, and therefore, more visible to the human eye than the transparent side walls 16 and 18 of the package 10.

In the approach depicted in FIG. 3, the first layer of adhesive material 30 extends continuously from the first side edge 20 to the second side edge 22 of the package 10. The first layer of adhesive material 30 is in the form of a strip that has a degree of opacity or translucence level such that it is partially opaque (i.e., translucent but not transparent) due to the presence of a colorant therein, as described above. As shown in FIG. 3, the strip forming the first layer of adhesive material 30 includes one or more, and as illustrated in the exemplary form, two areas, zones, or portions 13 and 15 that in one approach, include a thinner layer of adhesive material 30 than adjacent areas of the first layer of adhesive material 30, and in another approach, uncoated with adhesive material. As used herein, uncoated with adhesive material generally means free of, in the absence of, or no adhesive. The areas of the fastener 12 that form the visual indicators 13 and 15, whether they have a thinner layer of adhesive material 30 than adjacent areas of the first layer of adhesive material 30, or uncoated with adhesive material, are more translucent than adjacent areas of the first layer of adhesive material 30. In one approach, the areas 13 and 15 are transparent.

As discussed below, the areas 13 and 15 serve as visual indicators that can provide a consumer with information as to whether the package 10 has been properly sealed or not. As depicted in FIG. 3, the second layer of adhesive material 32 does not have visual indicators such as 13 and 15 and has an opacity level such that it is entirely partially opaque or uniformly translucent and extends continuously from the first side edge 20 to the second side edge 22 of the package 10. It is to be appreciated that the visual indicators 13 and 15 are not restricted to being present in only one of the first and second layers of adhesive material 30, 32 as shown in FIG. 3. For example, in one alternative approach, the second layer of adhesive material 32 may also include two visual indicators 13 and 15, such that both the first layer of adhesive material 30 and the second layer of adhesive material 32 each include one or more visual indicators 13, 15. In one form, the visual indicators 13, 15 of the first layer of adhesive material 30 are offset from the visual indicators 13, 15 of the second layer of adhesive material 32, facilitating a user in determining whether the package 10 is properly sealed from either the front or the rear of the package, i.e., by looking at the front wall 16 of the package 10, or the rear wall 18 of the package 10. It is to be appreciated that while two visual indicators 13 and 15 have been illustrated in the first layer of adhesive material 30 in FIGS. 1-3, and two visual indicators 13 and 15 can be in the second layer of adhesive material 32, it will be appreciated that the each of the first and second layers of adhesive material 30, 32 of the fastener 12 of the package 10 can include only one, three, four, five, or more such indicators as needed for a particular application to indicate that the package 10 is properly closed. It will also be appreciated that the opacity level of the second adhesive layer 32 may be the same as the opacity level of the first adhesive layer 30 (not counting the visual indicator zones 13 and 15). Alternatively, the opacity level of the first and second adhesive layers 30 and 32 may be different.

As shown in the exemplary form of FIGS. 1-3, the uncoated zones 13 and 15 in the first layer of adhesive material 30 are shaped in the form of circles. The visual indicators 13 and 15 have been illustrated as circles by way of example only, and it will be appreciated that the visual indicators 13 and 15 can have any shape and pattern. For example only, the visual indicators 13 and 15 may be in the form of simple geometric figures and shapes (for example, triangles, rectangles, squares, other polygons, straight lines, curved lines, and/or undulating lines, as well as irregular shapes) or letters (for example, "SAFETY SEAL," "FRESHNESS SEAL," or the like). In addition, the fastener 12 may have a plurality of identical visual indicators, or may have two or more visual indicators that are different from one another.

The reclosable fastener 12 generally has an adhesive bond strength to permit the opposing first and second layers of adhesive material 30 and 32 to be bonded together in order to close or seal the package 10. For example, when the package 10 is open as shown in FIG. 4, a consumer may reclose the package 10 by pressing the opposing first and second adhesive layers 30 and 32 toward each other and into engagement to fully seal or close the package 10. By one approach, the bond between first and second adhesive layers 30 and 32 is generally sufficient to seal the first and second adhesive layers 30 and 32 together and, preferably, form a hermetic seal. As used herein, hermetic is understood to mean a generally air tight seal, for example, no bubbles are visible in standard bubble emission leak test ASTM D 3078-02. In one example, the selected material forming the first and second adhesive layers 30 and 32 may exhibit a cohesive or peel bond strength between layers 30 and 32 of about 100 to about 700 g/inch, and in some cases, between about 100 to about 400 g/inch as measured by the ASTM peel test D 3330-Method F; however, the reclosable fastener 12 may have other peel strength values dependent on the particular application or particular measurement test.

As shown in FIG. 6, when the first and second layers of adhesive material 30 and 32 are not in contact (i.e., when the package 10 is not sealed), the opacity level of the second layer of adhesive material 32 is such that the first layer of adhesive material 30 is not visible when viewed directly through the second layer of adhesive material 32. Specifically, when the package 10 is not completely sealed or in an open position shown in FIGS. 4 and 6 such that the layers 30 and 32 are not in contact with each other and viewed by a consumer from the side of the front wall 16 along an axis 35 (shown in FIG. 4) representing the consumer's line of sight, the second layer of adhesive material 32, which is a continuous partially opaque coating, scatters and/or absorbs some of the incident light and obstructs the consumer's view of the visual indicators 13 and 15 in the first layer of adhesive material 30.

Conversely, when the package 10 is in the fully sealed condition shown in FIGS. 2 and 5, the total translucence level of the package 10 in the region of the fastener 12 is equal to the combined translucence levels of the first and second layers of adhesive material 30 and 32, except in the locations of the zones (not fully coated with, having a thinner layer of, or lacking adhesive material) representing the visual indicators 13 and 15. In the zones that represent the visual indicators 13 and 15, the translucence level of the fastener 12 is, in one approach, twice as great as the translucence level across the rest of the area representing the fastener 12. In other words, the opacity level of the package 10 in the region of the fastener 12 is, in one approach twice as great in the regions where two layers of adhesive material (i.e., the first and second layers 30 and 32) are present as compared to the regions where only one adhesive layer (i.e., the second layer 32) is present. As such, when the first and second layers of adhesive material 30 and 32 are in contact with each other, contact clarity results in the region of the fastener 12 such that the visual indicators 13 and 15 can be visible by the consumer through the second layer of adhesive material 32 along the line of sight or axis 35. It is to be appreciated that the areas of the fastener 12 where the visual indicators 13 and 15 are present may be more than or less than 50% more translucent (e.g., from about 25% to about 75%) than the remaining areas of the adhesive material across the fastener 12. The opacity level of the fastener 12 may be varied as needed by the thickness of the adhesive coating and/or the amount of colorant. For example, in alternative approaches, layers 30 and 32 of the fastener 12 may each be a different thickness and/or may each have a different amount of colorant.

The variation in the visibility of the visual indicators 13 and 15 through the second layer of adhesive material 32 between the open and closed conditions of the front and back walls 16 and 18 of the package 10 advantageously provides visual indication to a consumer regarding whether the package 10 is open or closed without the use of strips that change colors when moved from an open to a closed position and without the use of interlocking members that look different when open or closed. For example, neither the first adhesive layer 30 nor the second adhesive layer 32 of the package 10 changes colors when the package 10 is moved from an open condition to a closed condition. Instead, when the second adhesive layer 32 is in contact with the first adhesive layer 30 during the closed condition of the package 10, the fastener 12 is visibly more translucent in the areas where the visual indicators 13 and 15 are present and the second adhesive layer 32 does not change color but appears less opaque or more translucent opposite the areas where the visual indicators 13 and 15 are present. In other words, when the two adhesive layers 30 and 32 are joined, the pattern of contrasting opacity level caused by the presence of the visual indicators 13 and 15 becomes visible from the perspective of a consumer looking at the package 10 through the front panel.

As shown in FIG. 2, the portions of the fastener 12 where the more translucent or transparent zones representing the visual indicators 13 and 15 in the first layer of adhesive material 30 are in contact with the partially opaque second layer of adhesive material 32 appear as being more translucent or less opaque compared to the appearance of the portions of the fastener 12 where the partially opaque portions of the first adhesive layer 32 are in contact with the partially opaque second adhesive layer 32. As such, the ability of the consumer to see the shape represented by the visual indicators 13 and 15 provides a consumer with a confirmation that the package 10 has been fully sealed or reclosed. Conversely, the consumer's inability to see the shapes formed by the visual indicators 13 and 15 directly through the adhesive layer 32 is an indication that the package 10 has not been fully sealed because there is still a gap 31 between the first and second layers of adhesive material 30 and 32, as shown in FIG. 4. Accordingly, the visual indicators 13 and 15 advantageously provide the consumer with easily discernable information as to whether the package 10 has been properly or improperly sealed.

In one aspect, the fastener 12 may be a cohesive-based reclosable fastener generally constructed or have a composition adapted to minimize the adhesion of the fastener 12 to undesired surfaces and still function at the same time as an effective reclosable fastener. That is, the fastener 12 can be opened and closed multiple times to seal food products or other products in the interior 28 of the package 10 during use by a consumer, but at the same time not delaminate from the front and back walls 16 and 18 that form the side walls of the package 10. In one approach, the adhesive-based reclosable fastener 12, which has a strong bond to the front and back walls 16 and 18 of the package 10, includes an adhesive having relatively low tack levels to minimize adhesion to the unwanted surfaces such as food crumbs or cheese shreds, but with a bonding or opening peel strength sufficient to enable sealing or reclosure of the package 10 and permit unbonding to allow opening and/or re-opening of the package 10.

In one form, the material forming the package 10 can be a flexible sheet material or film, which may be formed of various plastic polymers, co-polymers, papers, or foils. The film substrate may be a multi-layer coextrusion and/or a laminate with constructions to enhance interfacial bonding with the energy-cured patterned adhesive fastener 12. In general, the polymeric layers may include polyolefins such as polyethylene (high, medium, low, linear low, and/or ultra low density polymers including metallocene or polypropylene (oriented and/or biaxially oriented)); polybutylene; ethylene vinyl acetate (EVA); polyamides such as nylon; polyethylene terephthalate; polyvinyl chloride; ethylene vinyl alcohol (EVOH); polyvinylidene chloride (PVDC); polyvinyl alcohol (PVOH); polystyrene; or combinations thereof, in monolayer or multi-layer combinations. In one aspect, the material forming the package 10 includes EVA. Examples of suitable material from which the flexible package 10 can be formed may be found in U.S. Publication Nos. 2008/0131636, 2008/0118688, and 2011/0211778, incorporated herein in their entirety. Other materials may also be used for the flexible package.

The first and second layers of adhesive material 30 and 32 of the fastener 12 can be formed from various suitable adhesive materials and can be provided in the form of a solution consisting of a thermoplastic elastomer diluted with an ethylene vinyl acetate copolymer in an organic solvent or mixture of organic solvents. The fastener 12 may be also formed from a UV-curable acrylic adhesive. Materials suitable for the fastener 12 are described, for example, in U.S. Publication Nos. 2009/0279813 and 2011/0211778, both incorporated by reference herein. By one approach, a suitable flexible film that can form the front and rear walls 16 and 18 of the package 10 may be a polyethylene-based film having a thickness of, in one approach, about 0.0005 to about 0.005 inches, in another approach, about 0.001 to about 0.005 inches, in another approach, from about 0.025 to about 0.005 inches. By way of example only, the first and second layers of adhesive material 30 and 32 of the fastener 12 can have a thickness of approximately from about 0.0001 to about 0.005 inches, in another approach, about 0.0005 to about 0.001 inches, in another approach, from about 0.001 to about 0.005 inches. In one form, the area of the first adhesive layer 30 forming the visual indicator 13 extends across the entire thickness of the first adhesive layer 30, as depicted in FIG. 4. It will be appreciated that the area forming the visual indicator 13 can extend across less than the entire thickness of the first adhesive layer 30.

In one approach, the materials forming the first and second adhesive layers 30 and 32 have a relatively low tack level that limits the adhesion of the fastener 12 to unwanted materials and surfaces, such as food particles, forming equipment surfaces, rollers, and the like. By one approach, the selected adhesive materials may have a tack level to undesired surfaces of not exceeding about 5 psi when preloaded with about 4.5 pounds and generally not exceeding about 15 psi when preloaded with about 10 pounds using the ASTM probe tack test D 2979; however, the tack level may also vary depending on the particular cohesive material chosen, application thereof and measurement test used.

Figure 7:
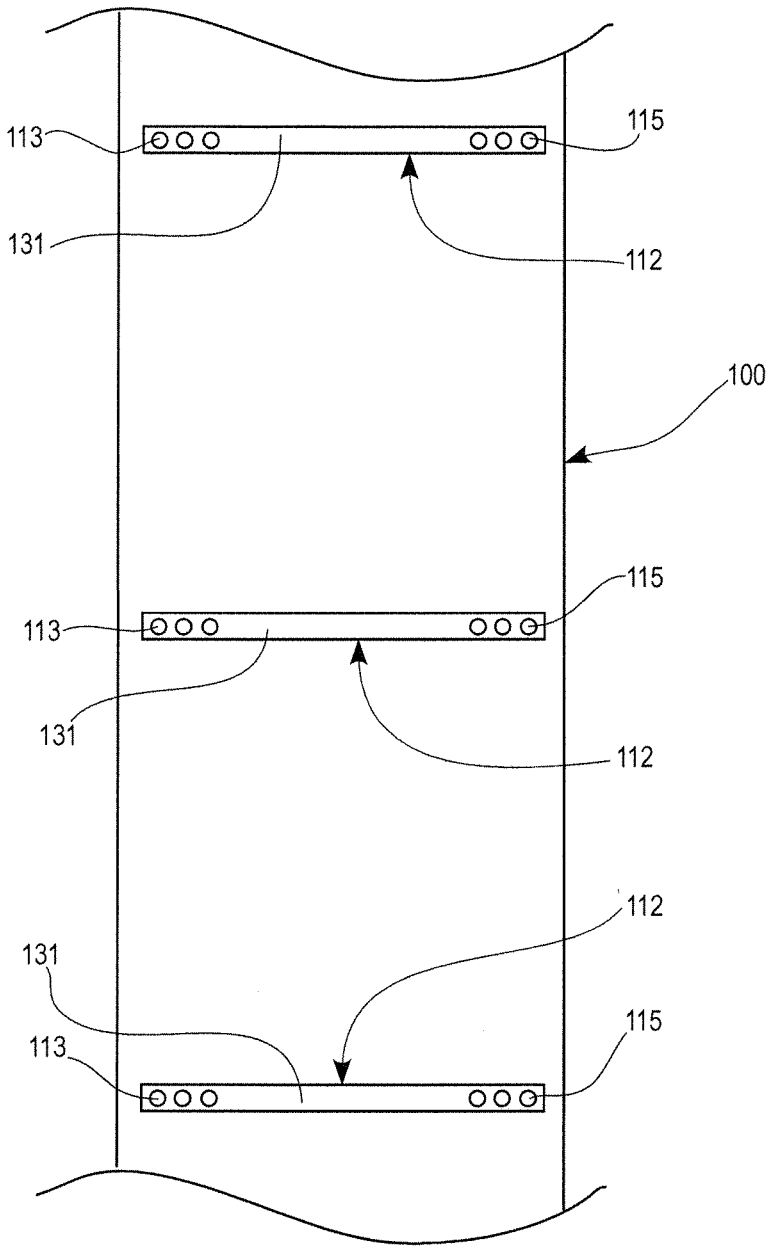
FIG. 7 is a top plan view of film rollstock that can be used to form an exemplary package including an adhesive fastener having visual indicators.

A suitable method of manufacturing the flexible package 10 including the first and second layers of adhesive material 30 and 32 is described with reference to FIGS. 7 and 8 below, and can comprise (1) applying the first layer of adhesive material 30 including at least one area 13 and 15 of predetermined shape to a portion of the interior surface 34 of the rear panel 18 of the flexible package 10; and (2) applying the second layer of adhesive material 32 to a portion of the interior surface 36 of the front panel 18 of the flexible package 10 opposite the portion of the interior surface 34 of the rear panel 18 of the flexible package 10. In one approach, after the application of the first and second layers of adhesive material, which may include titanium oxide, calcium carbonate, talc, or the like in an amount of approximately from 0.1 percent to 4 percent by weight, the first and second layers of adhesive material 30 and 32 are cured at a curing station. For example, the first and second layers of adhesive material 30 and 32 may be energy cured, such as UV-cured and/or E-beam cured. An exemplary method suitable for applying the first and second layers of adhesive material 30 and 32 to the front and rear walls 16 and 18, respectively, of the package 10 is described in 2011/0211778, which is incorporated by reference herein. The package 10 can be manufactured from a single sheet or web of flexible material 100. The flexible material 100 may be a film made of one or more plastic polymers, co-polymers, unmetalized or metalized laminates, paper, or the like. A portion of an exemplary web of the flexible film 100 is depicted in FIG. 7. In the approach illustrated in FIG. 7, the exemplary web of the flexible film 100 includes multiple areas or strips 112 that correspond to the fastener 12 in the formed flexible package 10. Specifically, the exemplary strips 112 include areas 131 coated with adhesive material that correspond to the first and second layers of adhesive material 30 and 32 of the formed flexible package 10. The exemplary strips 112 also include areas 113, 115 either lacking or having a thinner coating of the adhesive material that correspond to the visual indicators 13 and 15 of the formed package 10. It is to be appreciated that while the exemplary strips 112 have been shown in FIG. 7 in the form of a single continuous strip, each of the strips 112 may be in the form of two or more discontinuous or spaced apart strips, or strip-like areas. It is also to be appreciated that while the fastener 12 of the package 10 of FIG. 1 is shown with two visual indicators 13, 15, each strip 112 (that will form the fastener 212 of the package 200) depicted in FIG. 7 includes two sets of three visual indicators 113, 115, resulting in a total of six visual indicators.

Figure 8:
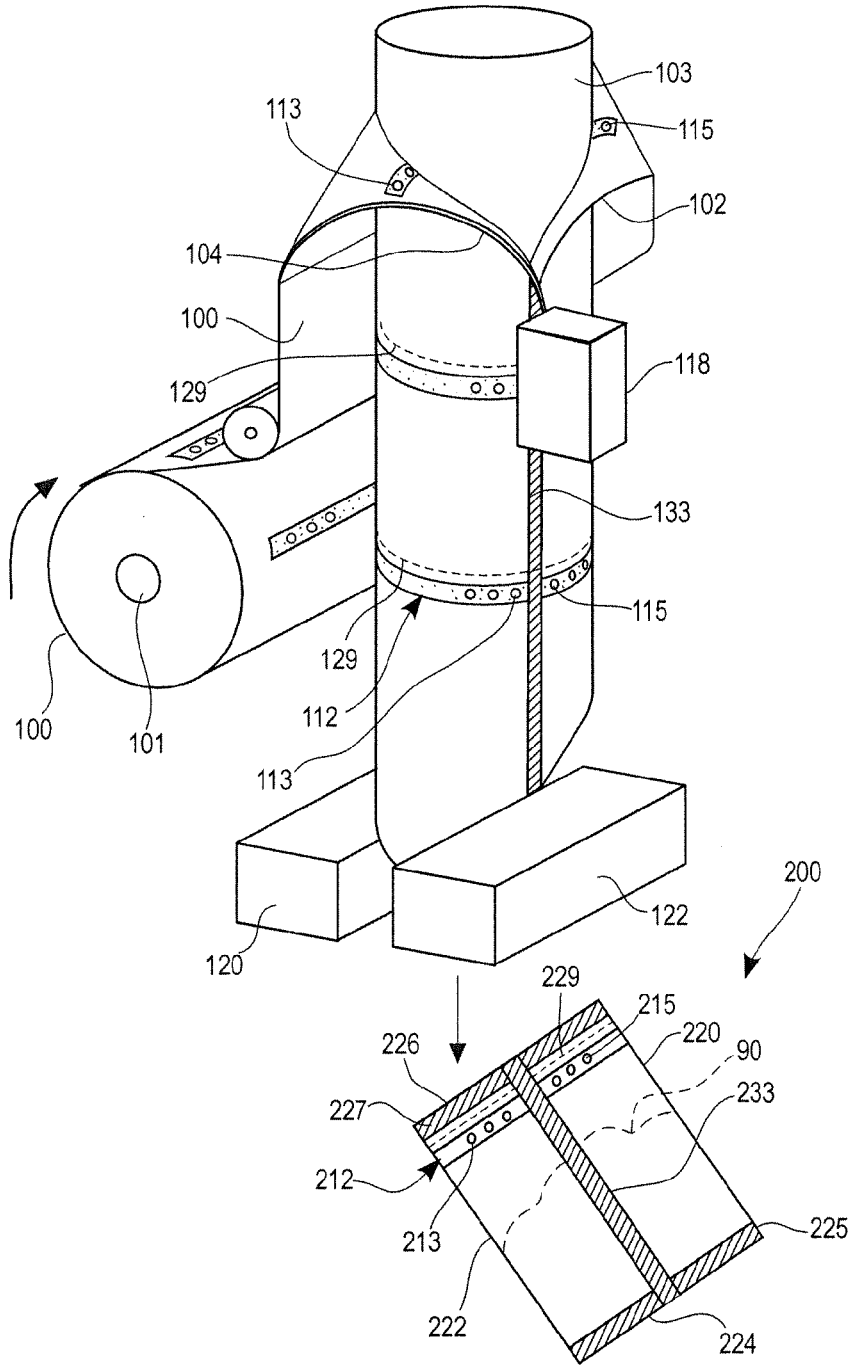
FIG. 8 is a perspective view of relevant portions of a vertical form-fill-seal process for forming an exemplary package from the film rollstock as shown in FIG. 7.

As the flexible film 100 moves in the machine direction shown by the directional arrow in FIG. 8, the film 100 includes a plurality of adhesive strips 112 described above. The strips 112 can be applied to, or made in the flexible film 100 before or after the flexible film 100 is unwound from the feed roll 101 in the machine direction. Prior to, or after disposing the strips 112 on the flexible film 100, lines of weakness 129 are formed in the flexible film 100 above the strips 112, as shown in FIG. 8. The lines of weakness 129 can be formed in the flexible film 100 using, for example, laser ablation, die-cutting, micro-abrasion, or other suitable means. The lines of weakness 129 in the flexible film 100 correspond to the line of weakness 29 and 229 of the exemplary packages 10 and 200, respectively.

As the flexible film 100 moved in the machine direction and along a vertical form-fill-seal device 103, the opposite longitudinal edges 102 and 104 of the flexible film 100 are folded inward such that both the longitudinal edges 102 and 104 of the flexible film 100 and the visual indicators 113 and 115 are brought toward each other as shown in FIG. 8, and a product 90 (e.g., a food product such as candy, chocolates, nuts, or the like, or another consumer product that is not a food product) is deposited into the vertical form-fill-seal device 103 such that the flexible film 100 envelopes the product 90. As shown in FIG. 8, sealing jaws 118 seal the longitudinal edges 102, 104 of the flexible film 100 together to form an area 133 which corresponds to a fin seal 33, 233 of the formed package 10 and 200, respectively. Finally, a cutting device such as cutting jaws 120 and 122 make one or more cuts though the flexible film 100 to singulate the individual exemplary package 200 as shown in FIG. 8.

The package 200 is substantially similar to the package 10 of FIGS. 1-6, but the fastener 212 of the package 200 includes two sets of three visual indicators 113, 115 instead of two visual indicators 13 and 15 as provided in the fastener 12 of the package 10. It will be appreciated that the number of visual indicators provided in the fasteners 12 and 212 have been chosen by way of example only, and that the number of visual indicators can be increased or decreased to suit a particular size and/or use of a package. For ease of reference, in FIG. 8, the aspects of the package 200 that are similar to the aspects of the package 10 have been designated with similar reference numbers, but prefaced with a "2."

The exemplary flexible packages 10 and 200 described herein provide advantages over the known packages in that they includes reclosable adhesive-based fasteners 12, 212 including visual indicators 13, 15, 213, 215 having contrasting opacity and differing translucence relative to the remainder of the fasteners 12, 212 and that can be easily applied to the flexible film from which the packages 10, 200 are formed during the manufacturing process. The visual indicators 13, 213 and 15, 215 of the fasteners 12, 212 do not rely on color changes in their operation and are easily observable even by people who are color-blind, unlike various color-changing visual indicators. To this end, in one approach, the difference in the opacity level of the reclosable fastener between the open and closed conditions is not categorical, but rather a matter of degree where the opacity level observed along the reclosable fastener appears to vary without changing the color of the fastener, between the open and closed conditions of the fasteners 12, 212. Finally, since the visual indicators 13, 213 and 15, 215 of the fasteners 12, 212 do not require any interlocking mechanical parts, the flexible packages 10, 200 are cheaper to manufacture than many of the presently known packages.

It will be understood that various changes in the details, materials, and arrangements of the package and process of formation thereof, which have been herein described and illustrated in order to explain the nature of the described package, may be made by those skilled in the art within the principle and scope of the embodied method as expressed in the appended claims.

What is claimed is:

1. A flexible package comprising:

a top end, a bottom end, a first side edge, a second side edge opposite the first side edge, a front panel, and a rear panel joined together to form an interior therebetween configured to retain a product;

a first layer of adhesive material disposed on an interior surface of the rear panel, the adhesive material of the first layer including at least one visual indicator formed by at least one area of predetermined shape that is more translucent than adjacent areas of the adhesive material of the first layer;

a second layer of adhesive material disposed on an interior surface of the front panel, the second layer of adhesive material being positioned opposite the first layer of adhesive material to permit the flexible package to be sealed when the first layer of adhesive material and the second layer of adhesive material are brought into contact with each other; and when the flexible package is not sealed, the at least one visual indicator in the adhesive material of the first layer is not visible through the adhesive material of the second layer, and when the flexible package is sealed, the at least one visual indicator is visible through the second layer of adhesive material.

2. The flexible package of claim 1, wherein each of the first layer of adhesive material and the second layer of adhesive material is in a form of at least one strip extending from the first side edge to the second side edge of the flexible package.

3. The flexible package of claim 1, wherein the shape of the at least one visual indicator is one of a geometric shape selected from one of circular, rectangular, triangular, and polygonal, and a calligraphic shape selected from one of single words and phrases.

4. The flexible package of claim 1, wherein the adhesive material of the first and second layers of adhesive material is one of partially opaque and translucent and includes a colorant in an amount of approximately from about 0.1 percent to about 4 percent by weight.

5. The flexible package of claim 4, wherein the colorant is selected from one of titanium dioxide, calcium carbonate, talc, or combinations thereof.

6. The flexible package of claim 1, wherein the first and second layers of adhesive material each have a thickness of approximately from about 0.0001 to about 0.005 inches.

7. The package of claim 1, wherein the first layer of adhesive material is partially opaque except for the at least one area of predetermined shape forming the at least one visual indicator, and the second layer of adhesive material is partially opaque.

8. A method of manufacturing the flexible package of claim 1, the method comprising:

applying the first layer of adhesive material including the at least one area of predetermined shape to a portion of the interior surface of the rear panel of the flexible package;

applying the second layer of adhesive material to a portion of the interior surface of the front panel of the flexible package opposite the portion of the interior surface of the rear panel of the flexible package.

9. The method of claim 8, further comprising bringing the front panel and the rear panel of the flexible package toward each other until the first layer of adhesive material comes into contact with the second layer of adhesive material and the flexible package is sealed.

10. The method of claim 8, wherein the applying the second layer includes applying the second layer of adhesive material to the portion of the interior surface of the front panel of the flexible package continuously from the first side edge of the flexible package to the second side edge of the flexible package.

11. The method of claim 8, wherein the applying the first layer includes applying the first layer to the portion of the interior surface of the rear panel of the flexible package continuously from the first side edge of the flexible package to the second side edge of the flexible package.

12. The method of claim 8, wherein the first layer of adhesive material and the second layer of adhesive material each include a colorant in an amount of approximately from about 0.1 percent to about 4 percent by weight.

13. A method of reclosing the flexible package of claim 1, the method comprising bringing the front panel and the rear panel of the flexible package toward each other until the first layer of adhesive material comes into contact with the second layer of adhesive material and the at least one visual indicator in the first layer of adhesive material is visible through the second layer of adhesive material.

14. A flexible package including a reclosable fastener comprising:

a top end, a bottom end, a first side edge, a second side edge opposite the first side edge, a front panel, and a rear panel joined together to form an interior therebetween configured to retain a product;

a reclosable fastener including:

a first strip of adhesive material disposed on an interior surface of the rear panel, the adhesive material of the first strip having a first translucence level and including at least one area forming a visual indicator and being more translucent than adjacent portions of the first strip of the adhesive material;

a second strip of adhesive material disposed on an interior surface of the front panel, the adhesive material of the second strip having a second translucence level, the second strip of adhesive material being positioned opposite the first strip of adhesive material to permit the flexible package to be sealed when the first strip of adhesive material and the second strip of adhesive material are brought into contact with each other; and when the flexible package is sealed, the reclosable fastener has a third translucence level in portions where the first strip of adhesive material is in contact with the second strip of adhesive material and a fourth translucence level where the at least one visual indicator is in contact with the second strip of adhesive material, the fourth translucence level being about 25-75% more translucent than the third translucence level such that the at least one visual indicator is visible through the second strip of adhesive material.

15. The flexible package of claim 14, wherein each of the first strip of adhesive material and the second strip of adhesive material extends from the first side edge to the second side edge of the flexible package.

16. The flexible package of claim 14, wherein a shape of the at least one visual indicator is one of a geometric shape selected from one of circular, rectangular, triangular, and polygonal, and a calligraphic shape selected from one of single words and phrases.

17. The flexible package of claim 14, wherein the adhesive material of the first and second strips includes a colorant in an amount of approximately from 0.1 percent to 4 percent by weight.

18. The flexible package of claim 14, wherein the first translucence is equal to the second translucence level.

19. The flexible package of claim 14, wherein neither the first strip of adhesive material nor the second strip of adhesive material changes color when the first and second strips of adhesive material are brought into contact with each other to seal the package.

20. The flexible package of claim 14, wherein when the flexible package is not sealed, the at least one visual indicator in the adhesive material of the first layer is not visible through the adhesive material of the second layer.

* * * * *